United States Patent [19]

Ushioda et al.

[11] Patent Number: 5,074,924

[45] Date of Patent: Dec. 24, 1991

[54] PROCESS FOR PRODUCING GALVANIZED, NON-AGING COLD ROLLED STEEL SHEETS HAVING GOOD FORMABILITY IN A CONTINUOUS GALVANIZING LINE

[75] Inventors: Kohsaku Ushioda; Osamu Akisue; Naoki Yoshinaga; Tomohisa Katayama; Masakazu Oshimi, all of Sagamihara, Japan

[73] Assignee: Nippon Steel Corporation, Tokyo, Japan

[21] Appl. No.: 541,732

[22] Filed: Jun. 21, 1990

[30] Foreign Application Priority Data

| | | | |
|---|---|---|---|
| Jun. 21, 1989 | [JP] | Japan | 1-158734 |
| Aug. 21, 1989 | [JP] | Japan | 1-213013 |
| Feb. 21, 1990 | [JP] | Japan | 2-38174 |

[51] Int. Cl.[5] ..... C21D 6/02; C21D 8/04

[52] U.S. Cl. ..... 148/11.5 R; 148/12.1; 148/12.3; 148/12 D

[58] Field of Search ..... 148/11.5 R, 12.1, 12.3, 148/12 D

[56] References Cited

U.S. PATENT DOCUMENTS

| | | | |
|---|---|---|---|
| 3,843,417 | 10/1919 | Ohbu et al. | 148/12 D |
| 3,936,324 | 2/1976 | Uchida et al. | 148/12.3 |
| 4,040,873 | 8/1977 | Nakaoka et al. | 148/12.3 |
| 4,294,632 | 10/1981 | Kubota et al. | 148/12.3 |
| 4,374,682 | 2/1983 | Abe et al. | 148/12.3 |
| 4,530,858 | 7/1985 | Brun | 148/12.3 |
| 4,981,531 | 1/1991 | Katoh et al. | 148/12.3 |

FOREIGN PATENT DOCUMENTS

| | | | |
|---|---|---|---|
| 56-11309 | 3/1981 | Japan . | |
| 56-14130 | 4/1981 | Japan . | |
| 56-51531 | 5/1981 | Japan . | |
| 0217638 | 12/1983 | Japan | 148/12.3 |
| 60-8289 | 3/1985 | Japan . | |
| 60-190525 | 9/1985 | Japan . | |
| 60-251226 | 12/1985 | Japan . | |
| 0139821 | 6/1987 | Japan | 148/12.3 |
| 62-4860 | 7/1987 | Japan . | |
| 0140039 | 6/1988 | Japan | 148/12.3 |
| 63-52088 | 10/1988 | Japan . | |

*Primary Examiner*—Upendra Roy

*Attorney, Agent, or Firm*—Wenderoth, Lind & Ponack

[57] ABSTRACT

A process for producing a non-aging galvanized steel sheet having good formability in a continuous galvanizing production line, which comprises heating a low carbon, Al-killed cold rolled steel sheet at a temperature not lower than a recrystallizing temperature, reducing the surface of the steel sheet thus heated in a reducing atmosphere, cooling the steel sheet to a temperature ($T_E$) ranging from 200° to 350° C. from a temperature not lower than 600° C. at a cooling rate not less than 30° C/s, holding the steel sheet at the temperature ($T_E$) for 0 to less than 10 seconds, reheating the steel sheet to a temperature ranging from 430° to 500° C. at a heating rate not less than 10° C/s, immersing the steel sheet into a molten zinc bath, cooling the steel sheet thus galvanized to a temperature not higher than 370° C., and subjecting the steel sheet to an overaging treatment to a temperature range from 250° to 320° C. for not shorter than 40 seconds. A modified process according to the present invention further comprises reheating the galvanized steel sheet to a temperature raning from 480° to 600° C. at a heating rate not lower than 10° C/s, and holding the sheet in this temperature range to perform alloying of the zinc coating layer with the steel substrate.

2 Claims, 6 Drawing Sheets

PROCESS FOR PRODUCING GALVANIZED, NON-AGING COLD ROLLED STEEL SHEETS HAVING GOOD FORMABILITY IN A CONTINUOUS GALVANIZING LINE

BACKGROUND OF THE INVENTION

1. Field of the Invention

The present invention relates to a process for producing galvanized non-aging steel sheets having good formability using low-carbon Al-killed steels with high production efficiency in a continuous galvanizing line of in-line annealing type.

2. Description of the Related Art

In recent years the tendencies in this field are toward the use of increasing amount of surface treated steel sheets for the purpose of improving the anti-rust property of steel sheets used in automobiles. Among the surface treated steel sheets, galvanized cold rolled steel sheets have been most commonly and widely used, and they are generally classified into two types: "as galvanized" and "galvannealed" (galvanized and alloyed). The galvanized and galvannealed sheets show remarkably improved spot-weldability as well as improved paint adhesion and corrosion resistance after paint coating due to the formation of the Fe-Zn alloy layer in the Zn surface layer.

The galvanized cold rolled steel sheets to which the present invention relates include from soft-grade cold rolled steel sheets having a tensile strength of 30 $Kgf/mm^2$ order to high strength grade cold rolled sheets having 35 to 45 $Kgf/mm^2$ order. The high strength grade sheets are particularly important because they can contribute for the weight reduction of automobiles which in turn contributes to improve the fuel consumption rate. This has been of increasing concern from the view point of the environment protection of the earth.

The conventional in-line annealing type continuous production of galvanized steel sheets with a high production efficiency generally comprises the following steps. First prior to the galvanizing, the steel strip is heated in a reducing atmosphere. This heating serves not only to clean the strip surface, but also to promote the recrystallization of the steel strip simultaneously. Thereafter, the steel strip is cooled, immersed in the zinc bath, and if the case needs, subjected to an alloying treatment, to obtain final galvanized sheet products. As understood from the above general description of the in-line annealing type production, it is a very rationalized and economical continuous production line.

Meanwhile the galvanized cold rolled steel sheets must have excellent formabilities and must be non-strain-aging, which are required by their final uses. The strain-aging is caused by carbon and nitrogen remaining in solid solution in the steel sheets and develops as surface defects called "stretcher strain" after press formings, or in the mono-axial tensile tests, it appears as material deteriorations along the lapse of time such as the increase of yield strength (YP), the lowering of elongation (El) and yield point elongation (YP-El).

Conventionally the galvanized cold rolled steel sheets satisfying the above requirements of the material qualities have been produced mainly by the following two production methods.

The first method uses a super low carbon steel containing carbides and nitrides forming elements, such as Ti and Nb, and this method enables the production of galvanized steel sheets having excellent formability and free from the strain-aging in the in-line annealing type continuous galvanizing line. However as this method requires the addition of highly costing Ti and Nb and a vacuum degassing treatment of molten steel, the method is disadvantageous in that the material cost remarkably increases. Further, regarding the material qualities, this method has the following disadvantages.

(1) As carbon and nitrogen are almost completely fixed in the steel sheets obtained by this method, no satisfactory bake hardenability (hereinafter abridged as BH) is achieved, although the non-strain-aging property is satisfied, so that the resistance to dent is poor.

(2) As carbon and nitrogen are almost completely fixed as mentioned above, carbon and nitrogen are no longer present in the grain boundaries so that during the alloying treatment, in particular, Zn will intrude into the grain boundaries. This Zn will cause surface defects such as outbursts, and deterioration of the formability due to the grain boundary embrittlement.

(3) During the reduction step, the surface of the sheets being treated will be excessively activated, causing the formation of brittle gamma phase in the intersurface between the steel substrate and the zinc coating, which in turn causes a poor adhesion of the zinc coating or requires modification or adjustment of the Al concentration in the zinc bath.

Meanwhile the second method uses low-costing low carbon Al-killed steels as the starting material. However, in the conventional continuous galvanizing line, the sheets from this material contain a large amount of carbon remaining in solid solution which will cause remarkable strain aging of the sheets. This is particularly remarkable in the case of low carbon Al-killed steels containing positively added phosphorus. Therefore this method requires a batch type post-annealing step as a necessity in order to reduce the amount of carbon in solid solution, which inevitably results in an unduly elongated production process, thus failing to take full advantage of the highly efficient continuous galvanizing production line. Further, after the post-annealing, the amount of carbon in solid solution is excessively reduced so that the desired BH property disappears.

The present invention has been completed to solve the above mentioned problems of the conventional production methods for galvanized steel sheets, and the features of the present invention reside (1) in the use of low costing, low carbon Al-killed steel as the starting material, and (2) the adoption of a heat cycle in the continuous production line of galvanized steel sheets, which heat cycle has been established on the basis of the kinetic theories of the nucleation and growth of cementite.

Over-aging treatments of continuous galvanized steel sheets have conventionally been performed in the production line by various methods as disclosed in Japanese patent Publications Sho 56-11309, Sho 60-8289, Sho 63-52088, Japanese Laid-Open Patent Applications Sho 56-51531, and Sho 60-251226.

The method disclosed in Japanese Patent Publication Sho 56-11309 comprises immersing a cold rolled sheet from a temperature of not lower than 550° C. directly into a molten zinc bath controlled at about 460° C. to galvanize the sheet and simultaneously to dissolve the carbon in the sheet oversaturately in solid solution by the rapid cooling achieved by the immersion, then subjecting the galvanized sheet to an over-aging treatment in a temperature range from 300° to 460° C. to improve the formability of the sheet. This method, however, so far as the present inventors carefully studied and found, has the following defects.

(1) The direct immersion of the sheet into the molten zinc bath from a high temperature impairs the adhesion of the zinc coating.

(2) With the quenching in the zinc bath at about 460° C. and the subsequent over-aging in the temperature range from 300° to 460° C., the amount of carbon in solid solution will not be reduced (for example lower than 6 ppm) enough to achieve the non-strain-aging property, except when the sheet is subjected to a long time overaging treatment at a low temperature as 300° C.

(3) If the overaging temperature exceeds 370° C., the zinc deposited on the sheets adheres to the hearth rolls during the overaging treatment, causing surface defects on the galvanized sheets.

The methods disclosed in Japanese Patent Publications Sho 60-8289 and Sho 63-52088 have the same basic technical concept in the following points. Thus the sheets galvanized in a continuous galvanizing line are forcedly cooled and continuously overaged in the same production line. For the overaging, the galvanized sheets are rapidly heated to the overaging temperatures. According to Japanese Patent Publication Sho 60-8289, the overaging is performed in the range from 300° to 600° C., and according to Japanese Patent Publication Sho 63-52088, the overaging is performed in the range from 340° to 370° C. when no subsequent alloying treatment is to be performed, and in the range from 425° to 460° C. when the subsequent alloying treatment is to be done, and then the sheets thus overaged are slowly cooled.

So far as the present inventors have studied the above two prior art methods, they have the following technical problems.

(1) When the overaging treatment of the galvanized sheets is performed at a temperature exceeding 370° C., the zinc deposited on the sheets adheres to the hearth rolls, causing surface defects on the sheets.

(2) According to Japanese Patent Publication Sho 60-8289, the sheets are rapidly heated with a heating rate of 50° C./s or higher to the overaging temperature so as to induce dislocations in the steel matrix and to precipitate the carbon in solid solution thereinto. However the careful studies by the present inventors revealed that the precipitation site of the carbon in solid solution is predominated by MnS already existing in the grains, and the rapid heating is not always necessary.

(3) The precipitation rate of carbon during the overaging depends on the degree of oversaturation of carbon before the overaging treatment. However, this prior art publication provides no sufficient disclosure in this regard, and so far as understood, the oversaturation degree can never be satisfactory.

(4) The amount of carbon in solid solution remaining after the overaging cannot be reduced enough (6 ppm or less) to assure the non-strain-aging property by the prior art of Japanese patent Publication Sho 63-52088 because of the high overaging temperature.

According to Japanese Laid-Open patent Application Sho 56-51531, the steel sheets are subjected to a recrystallization annealing, rapidly cooled to a temperature ranging from 300° to 500° C. at a cooling rate of 70° C./s or higher, then held in the same temperature range for 10 seconds or longer to perform the overaging. The galvanizing is performed before or after the overaging treatment.

The studies by the present inventors on this prior art revealed the following technical problems.

(1) For the nucleation of cementite in the grains, the holding of the sheets at the final point of the rapid cooling temperature range in this prior art is effective, but the holding time is too long. It has been found by the present inventors that the carbon can diffuse during the reheating to the galvanizing temperature and can form enough nuclei of cementite in the grains and that a holding time less than 10 seconds is enough or even no holding is necessary.

(2) The holding for 10 seconds or longer is too long for industrial applications to practical continuous galvanizing lines, and inevitably requires an increased size of plants and equipments.

(3) As the cementite nuclei formed in the grains by the holding at the final temperature of the rapid cooling are dissolved and disappear during the reheating, the prior art is limited to the galvanizing process and does not suggest the galvannealing process which is performed at temperatures higher than the galvanizing temperatures.

(4) For the purpose of preventing the surface defects caused by the zinc adhesion on the hearth rolls, it is necessary that the sheet temperature at which the sheet contacts the hearth rolls for the first time after the galvanizing treatment is not higher than 370° C. Therefore the prior art is susceptible to this type of surface defects.

Further, the production of galvanized high-strength cold rolled steel sheets has been done in the continuous galvanizing line using a low carbon Al-killed steel with positive addition of phosphorus as disclosed in Japanese Patent Publication Sho 56-14130. However, this prior art teaches nothing of the overaging treatment and the galvanized sheets obtained by this prior art are supposed to be very inferior with respect to the non-strain-aging property. Also Japanese Laid-open patent Application Sho 62-4860 teaches a similar method, but is basically different from the present invention, and the desired non-strain-aging property can never be obtained by the overaging treatment disclosed by the prior art publication. Still further, Japanese Laid-Open Patent Application Sho 60-190525 discloses a heat cycle for a non-aging property similar to the present invention. However this prior art publication discloses nothing of the galvanizing process or the alloying process.

The galvanized steel sheets, in general, show inferior formability as compared with their substrate steel because of the presence of the zinc layer or the zinc-iron alloy layer on the surface. Therefore, it is very important for assuring excellent formability of the galvanized sheets that the formabilities of the substrates are improved beforehand. For assuring good formability of low carbon Al-killed steel sheets, the following basic considerations are essential.

(1) The cementite in the hot rolled sheet should be coagulated and coarsened, and (2) the precipitation of AlN should be fully promoted to coarsen the grains.

For these purposes, the high temperature coiling of hot rolled strips have been conventionally adopted.

However, the high temperature coiling technics are accompanied by the following two technical problems.

(1) Both leading and tailing ends of the hot strip are subjected to a rapid cooling and deteriorated in material qualities. Therefore these end portions must be cut off, causing a lowered production yield.

(2) The scale on the hot rolled strip is increased by the high temperature coiling, causing difficulties in the acid pickling and hence a lowered production efficiency.

For solving the above technical problems of the high temperature coiling, the low temperature coiling technics have been proposed. However, the low temperature coiling is effective only to improve the production yield and efficiency. Meanwhile from the point of improving the formability, in the present invention the coiling temperature may be lower or higher so far as the formability is improved.

SUMMARY OF THE INVENTION

The present invention has been completed for the object of solving the above technical problems of the prior arts, and provides novel technics for producing galvanized steel sheets and galvannealed steel sheets free from the strain-aging, having the bake hardenability, excellent press formability and a good surface quality by using a low carbon Al-killed steel strip in a continuous galvanizing line of in-line annealing type.

According to the present invention it is possible to produce a galvanized soft grade cold rolled steel sheet having strength of 30 Kgt/mm$^2$ order, a BH value not lower than 3 Kgf/mm$^2$ and a non-strain aging property, which shows an yield point elongation not higher than 0.2% after an artificial aging at 100° C. for one hour after temper rolling and shows an yield strength not higher than 20 Kgf/mm$^2$, an elongation not lower than 43% and an $\bar{r}$ value not lower than 1.5.

It is also possible to produce a galvanized high-strength cold rolled steel sheet having strength of 35 to 45 Kgf/mm$^2$ order, which shows similar BH value and non-strain aging property as above and further shows an yield strength not lower than 26 Kgf/mm$^2$, an elongation not lower than 35% and an $\bar{r}$ value not lower than 1.2.

The basic process according to the present invention comprises heating a low carbon Al-killed cold rolled steel sheet or strip (herein called "sheet") at a temperature not lower than a recrystallization temperature, reducing the surface of the sheet in a reducing atmosphere, cooling the sheet to a temperature ($T_E$) ranging from 200° to 350° C., preferably 230° to 300° C. from a temperature not lower than 600° C. at a cooling rate not lower than 30° C./s, preferably 50° to 120° C./s holding the sheet at the temperature ($T_E$) for 0 to not longer than 10 seconds, preferably 1 to 5 seconds, heating the sheet to a temperature ranging from 430° to 500° C. at a heating rate not lower than 10° C./s, preferably 20° to 100° C./s, immersing the sheet thus heated into a molten zinc bath, cooling the sheet thus galvanized to a temperature not higher than 370° C., preferably 280° to 360° C. and subjecting the sheet to an overaging treatment for not shorter than 40 seconds through a temperature range from 250° to 320° C.

A modified process according to the present invention further comprises reheating the galvanized steel sheet to a temperature ranging from 480° to 600° C. at a heating rate not lower than 10° C./s, and holding the sheet in this temperature range to perform alloying of the zinc coating layer with the steel substrate.

According to the present invention, the low carbon Al-killed steel sheet used as the starting material may be obtained by hot rolling a low carbon Al-killed steel slab containing by weight 0.01 to 0.02% carbon, not more than 0.3% silicon, 0.03 to 0.15% manganese, not more than 0.02% phosphorus, not more than 0.015% sulfur, 0.04 to 0.10% aluminum, not more than 0.003% nitrogen, with the balance being iron and unavoidable impurities, coiling the strip in a temperature range from 600° to 700° C., and then cold rolling the hot rolled strip.

Further the hot rolling of the low carbon Al-killed steel slab may be performed by soaking the slab under the following temperature condition (ST):

$$950^\circ\ C. \leqq ST \leqq 7Mn/S + 1050^\circ\ C.$$

and then the hot rolling is performed with a finishing temperature not lower than Ar3 and a coiling temperature between 600° and 700° C.

Still further for applications where high strength is particularly important, a low carbon, phosphorus-containing Al-killed cold rolled steel sheet may be used as the starting material, which contains by weight 0.01 to 0.04% carbon, not more than 0.5% silicon, 0.03 to 0.40% manganese, 0.020 to 0.13%, preferably 0.025 to 0.13% phosphorus, not more than 0.02% sulfur, 0.02 to 0.10% aluminum, not more than 0.007% nitrogen, with the balance being iron and unavoidable impurities.

For the production of galvanized steel sheets or galvannealed steel sheets having non-strain-aging property, high bake hardenability as well as excellent press formability in a very compact, rationalized production line as a continuous galvanizing process line of in-line annealing type as in the present invention, the following technical considerations required by newly found discoveries must be fulfilled.

Thus in order to achieve the non-strain-aging property while assuring the desired BH property by the production in a continuous galvanizing line, it is necessary to restrict the carbon in solid solution in the steel substrate to a very narrow range, for example, from 2 to 6 ppm as a pre-condition for elimination of surface defects irrespective of whether the galvanized sheet is alloyed or not. This can be achieved only by performing an optimum heat cycle based on the theories of the formation and growth of the cementite nuclei in the grains.

In all of the figures, (*a*) represents the case where no alloying treatment is performed while (*b*) represents the case where an alloying treatment is performed.

Figure 5:
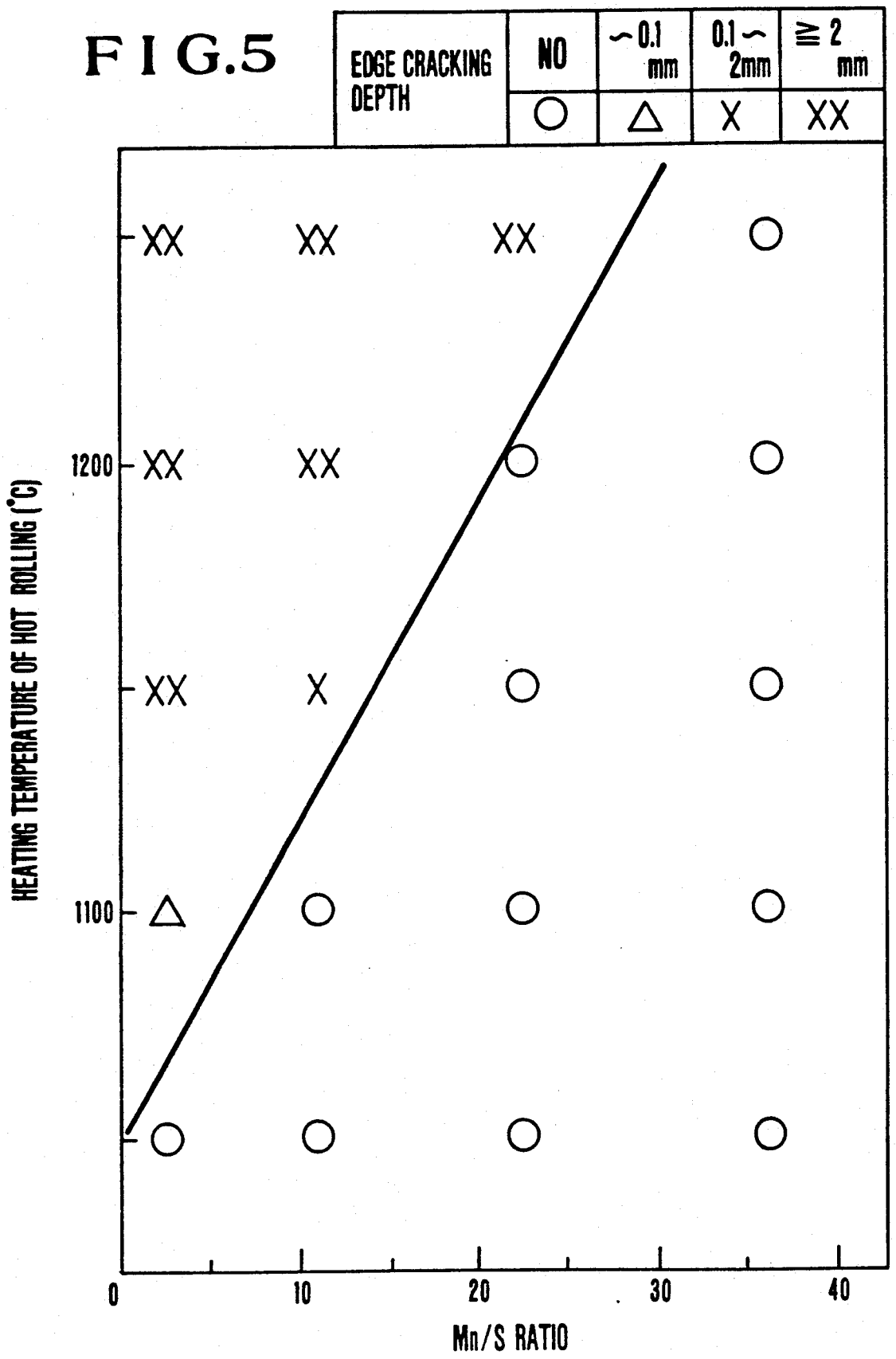

FIG. 5 shows the relation between the occurrence of edge cracks and the Mn/S ratio as well as the slab reheating temperatures.

DETAILED DESCRIPTION OF THE INVENTION

The present invention will be described in more details referring to the accompanying drawings.

As for the starting steel sheet material used in the present invention, ordinary low carbon, Al-killed cold rolled steel sheets, or phosphorus-containing low carbon, Al-killed steel sheets may be used. However, for special purpose, steel sheets of specific compositions or obtained by specific hot rolling conditions as described hereinafter are desirable.

The conditions of the continuous galvanizing process of in-line annealing type are very important for the production of galvanized steel sheets or galvannealed steel sheets having excellent formability and good surface qualities yet maintaining the non-strain-aging property and the desired BH property of the low carbon Al-killed cold rolled steel sheets.

Thus, according to the present invention, the steel sheets are heated at a temperature not lower than the recrystallization temperature and then the sheet surface is reduced in a reducing atmosphere. For fully improving the $\bar{r}$ value and fully soften the steel, it is desirable to maintain the steel sheets at a temperature range from 750° to 880° C. in the reducing zone. Then the steel sheets are rapidly cooled from a temperature not lower than 600° C. at a cooling rate not less than 30° C./s. These conditions play important roles for maintaining a supersaturation of carbon necessary for precipitation of cementite in the grains during the subsequent heat treatments. If the rapid cooling is done from a temperature lower than 600° C., or if the cooling rate is less than 30° C./s, the supersaturation degree of carbon will be insufficient so that the density of cementite precipitation in the grains will be lower and satisfactory non-strain-aging cannot be achieved. Needless to say, the rapid cooling must be done in such a manner that the activated steel surface is not damaged so as to assure a good zinc coat adhesion in the subsequent galvanizing step.

The finishing temperature of the rapid cooling and the holding at the temperature are very important factors deciding the density of the cementite in the grains, hence the amount of the carbon in solid solution, and constitute the basic features of the present invention.

Detailed description will be made on these features with reference to the experimental data.

The effects on the non-strain-aging property and the BH property by the holding time at the finishing temperature of the rapid cooling have been investigated using standard specimens of the present invention as shown in Table 1.

TABLE 1

| Chemical Composition (wt. %) and Hot and Cold Rolling Conditions of Standard Steel Sheets Used in the Invention | | | | | | | | | | | |
|---|---|---|---|---|---|---|---|---|---|---|---|
| C | Si | Mn | P | S | Al | N | SRT (°C.) | Ft (°C.) | CT (°C.) | CR (%) | t (mm) |
| 0.024 | 0.01 | 0.15 | 0.009 | 0.006 | 0.042 | 0.0028 | 1080 | 895 | 720 | 82.8 | 0.8 |

Figure 1:
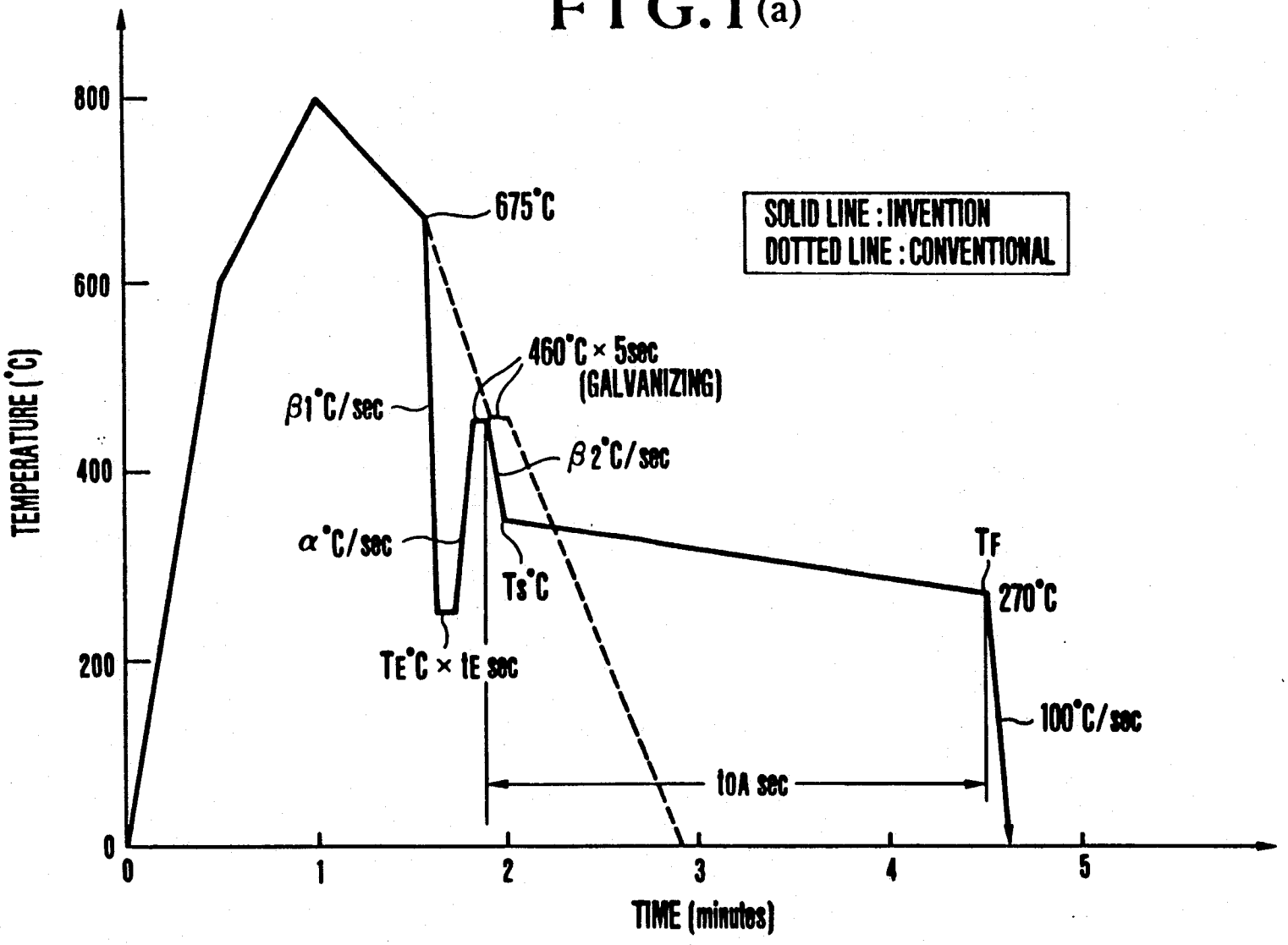
FIGS. 1(*a*) shows standard heat cycles for the case where no alloying treatment is performed and FIG. 1(*b*) shows standard heat cycles for the case where an alloying treatment is performed.
Figure 2A:
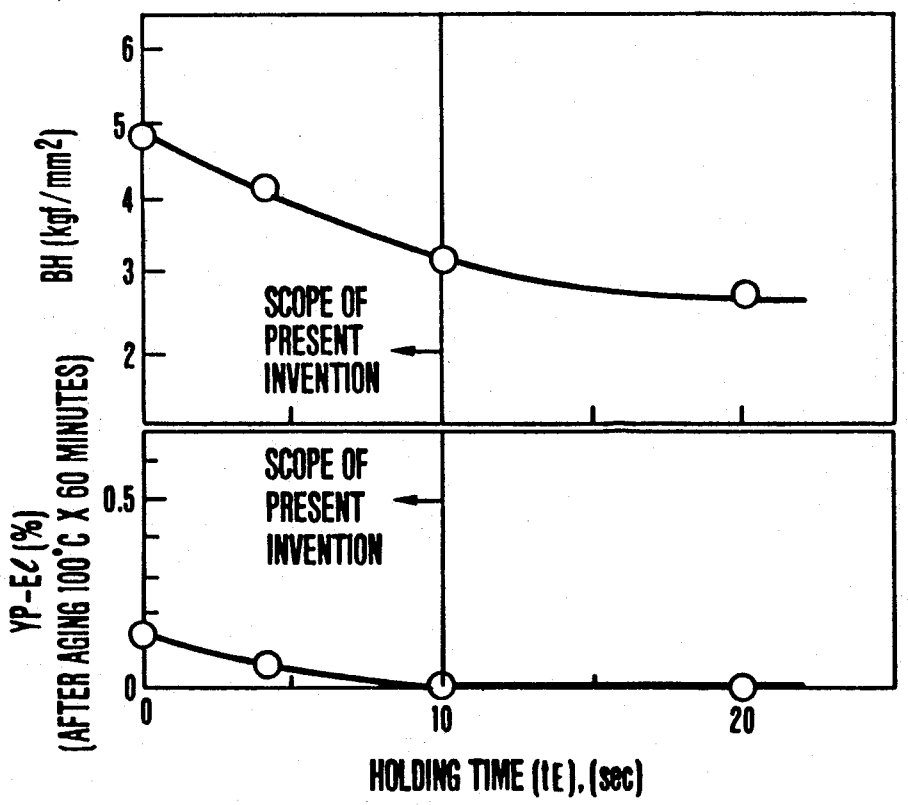
FIGS. 2(*a*) and 2(*b*) show the relation between the BH property of the products and YP-El as well as the holding time ($t_E$ in FIG. 1).
Figure 2B:
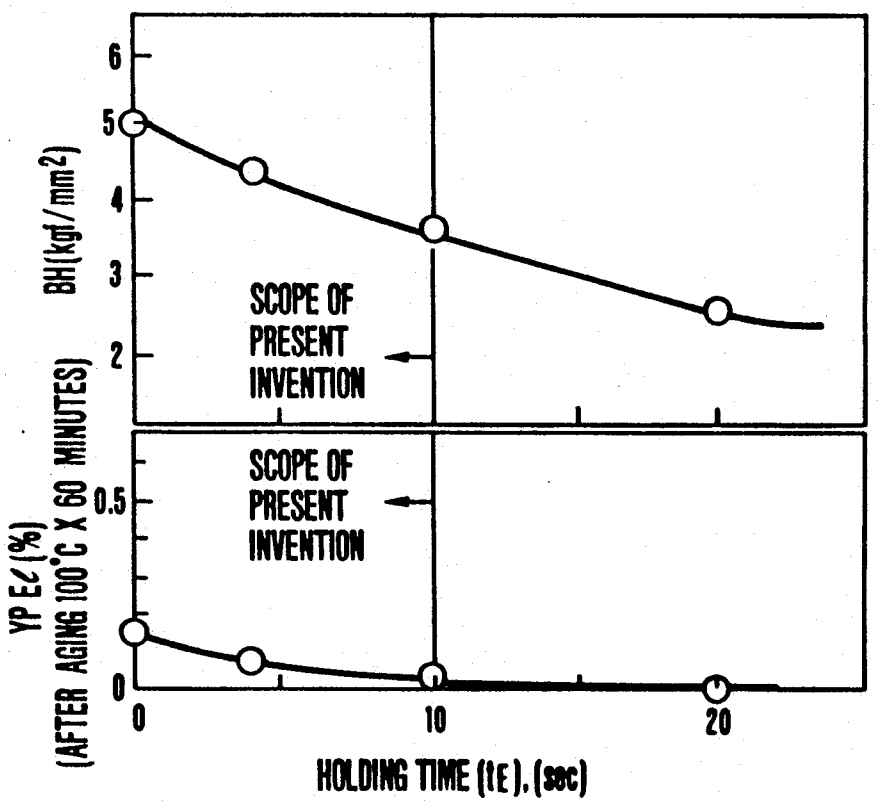

SRT: Slab re-heating temperature
FT: Finishing temperature of hot rolling
CT: Coiling temperature of hot-rolled band
CR: Cold rolling reduction rate
t: Thickness of cold rolled steel sheet Typical heat cycles according to the present invention for the continuous galvanizing process without an alloying treatment and the continuous galvanizing process incorporating an alloying treatment are shown in FIGS. 1(*a*) and 1(*b*) in comparison with the conventional heat cycles. The properties obtained by these heat cycles are shown in FIG. 2(*a*) and 2(*b*). In these examples of the heat cycles according to the present invention, the cooling rate $\beta_1$ is 100° C./s, the finishing temperature $T_E$ of the rapid cooling is 250° C., the reheating rate $\alpha$, $\alpha_1$, $\alpha_2$ is 50° C./s, the cooling rate $\beta_2$ after the galvanizing step and after the alloying treatment is 50° C./s, the finishing temperature $T_S$ of the cooling is 350° C. and the overaging time $t_{OA}$ is 150 seconds. The non-strain-aging property is evaluated by the yield point elongation values obtained by subjecting test pieces obtained by 1.0% temper rolling and artificial aging at 100° C. for 60 minutes to tensile tests. By separate investigation it has been found that if the yield point elongation is not more than 0.2%, the desired non-strain-aging property can be maintained by the galvanized steel sheets and galvannealed steel sheets to a degree as maintained by a cold rolled sheets.

As clearly understood from FIGS. 2(*a*) and 2(*b*), for the purpose of maintaining the non-strain-aging property and yet providing the desired BH property, the holding at the finishing temperature (250° C.) of the rapid cooling is effective and the holding time of 0 to not longer than 10 seconds is enough for the purpose. The holding longer than 10 seconds produces no substantial effect.

The effect of the short time holding may be attributed to the fact that the holding contributes to form the cementite nuclei densely in the grains in which carbon can be present supersaturately. However, the formation of cementite nuclei is effected not only during the holding, but also during the subsequent heating due to the diffusion of carbon. Therefore it is not considered to be advantageous to hold the steel sheets for 10 seconds or longer. For example it has been found that even if the holding time is zero, the cementite nuclei are formed in a satisfying density in the grains during the reheating. Therefore, the desired result can be obtained without the holding. Further from the point of commercial practices, the holding for 10 seconds or longer requires an increased size of a furnace and an increased capital cost, and lowers the production line speed, thus lowering the production efficiency. For these reasons the holding time is desired to be in the range from 0 to shorter than 10 seconds.

The effects of the finishing temperature ($T_E$) will be described in the Example 2 hereinafter. If the temperature exceeds 350° C., the desired supersaturation degree of carbon cannot be maintained so that the desired non-strain-aging property is not achieved. On the other hand, if the temperature $T_E$ is below 200° C., although the non-strain-aging property is satisfied, the amount of solid solution carbon decreases excessively so that the desired BH property cannot be obtained, and further the carbides in the grains become too dense, hence hardening the steel excessively. Still further if the temperature $T_E$ is below 200° C., the energy required by the reheating increases, resulting in an increased energy cost.

Further it has been found by the present inventors through detailed experiments that the nucleation of cementite in the grains takes place at a high frequency in the temperature range from the finishing temperature of the rapid cooling to about 350° C. in the reheating step, and the cementite nuclei formed above about 350° C. in the reheating step grow coarser, and the number of cementite nuclei does not substantially change if the temperature is increased to not higher than the alloying temperature. However, if the temperature exceeds about 550° C., part of the cementite dissolves and disappears and if the temperature exceeds about 600° C., the number of cementites remarkably decreases so that the effect of the cementite in the grains to render the steel to be non-strain-aging is no more present.

The above findings by the present inventors are quite contrary to the teachings of Japanese Laid-Open Patent Application Sho 60-251226 that the nucleation of cementite in the grains is caused only during the holding for not shorter than 10 seconds at the finishing temperature of the rapid cooling and during the subsequent reheating step these nuclei are partially dissolved and disappear so that the number of the nuclei decreases. Therefore this prior art intends to exclude an alloying step and has no notion of the alloying step.

Whereas the present invention made on the basis of the above findings of the nucleation and growth kinetics of cementite in the grains is directed to production of galvanized steel sheets and also galvannealed steel sheets.

After the holding at the finishing temperature of the rapid cooling, the steel sheets are reheated at a heating rate not less than 10° C./s, and immersed in a molten zinc bath maintained in the temperature range from 430° to 500° C. In order to improve the coating adhesion, the steel sheets are heated to about the bath temperature beforehand, and as the cases require, the galvanized steel sheets are further subjected to an alloying treatment. For performing the alloying treatment, the galvanized steel sheets are heated to a temperature ranging from 480° to 600° C. at a heating rate not less than 10° C./s, and held at the temperature for 5 to 40 seconds. In this connection, the heating rate less than 10° C./s is preferable for the purpose of forming the cementite nuclei in the grains during the heating, but requires an increased capacity of the furnace, thus prohibiting a commercial practice.

Regarding the molten zinc bath temperature, at a bath temperature lower than 430° C., the galvanizing operation becomes unstable, while if the bath temperature exceeds 500° C., the adhesion of the coated zinc will be unsatisfactory.

Regarding the alloying treatment, if the alloying temperature or time is lower or shorter than the above specified temperature or time, the alloying will be insufficient and on the other hand, if the temperature or time is higher or longer, the alloying proceeds excessively and the phase which deteriorates the formability is formed in the interface between the steel substrate and the zinc coating layer. Further if the temperature exceeds 600° C., most of the cementite in the grains will disappear and the desired results of the present invention can not be obtained.

The steel sheets galvanized or further alloyed are cooled to the temperature ($T_S$) not higher than 370° C. and brought into contact with hearth rolls for the first time, bent, and subsequently subjected to the overaging treatment. At this time if the temperature exceeds 370° C., the zinc coating or the alloyed layer, which is still soft at this temperature, adheres to the surface of the rolls and causes the surface defects on the galvanized steel sheets. The cooling from the temperature ($T_S$) to the finishing temperature ($T_F$: 250° to 320° C.) of the overaging treatment is performed over 40 seconds or longer so as to promote the growth of the nuclei and to reduce the amount of the carbon in solid solution to 6 ppm or less, for example. If the finishing temperature ($T_F$) is lower than 250° C. and the overaging time is short, the amount of the remaining carbon in solid solution becomes excessive so that the non-strain-aging property is lost. On the other hand if the temperature ($T_F$) is lower than 250° C. and the overaging time is long enough, the amount of the remaining carbon in solid solution becomes too little so that the desired BH property cannot be obtained.

Further, if the temperature ($T_F$) exceeds 320° C., the amount of the remaining carbon in solid solution will be more than 6 ppm so that the non-strain-aging property is lost. Meanwhile if the overaging time is shorter than 40 seconds, the desired non-strain-aging property cannot be obtained even by the efficient overaging treatment as defined by the present invention.

In this connection, the cooling from the temperature $T_S$ to $T_F$, the straight slide cooling is not always necessary, and it is desired to cool the steel sheets along the theoretical optimum cooling curve published by K. Kurihara and N. Nakaoka in "Metallurgy of Continuous Annealed Steel Sheet" ed.B.L. Bramfitt and P.L. Mangonon: TMS-AIME (1982), pages 117 to 132.

The conditions of the heat cycles mentioned above can be applied to the steel sheets in which phosphorus is added for the purpose of increasing the strength basically without modifications. However, as phosphorus restricts the cementite precipitation, the amount of carbon in solid solution after the continuous annealing tends to increase.

The conventional knowledge is that the addition of phosphorus in the steel tends to delay the alloying reaction and deteriorate the coating adhesion and tends to lower the production efficientcy. It has been found by the present inventors that these adverse effects of the phosphorus addition can be eliminated by confining the cementites in the grains.

More detailed description will be made on the starting steel sheets. As mentioned hereinbefore, ordinary low carbon Al-killed cold rolled steel sheets may be used as soft grades having a strength of 30 Kgf/mm$^2$ order, but the steel compositions and the hot rolling conditions mentioned below are most preferable.

Generally in order to obtain satisfactory formability of cold rolled and annealed steel sheets, it has been known to coil hot rolled steel sheets at high temperatures. Therefore high temperature coiled hot rolled steel sheets may be used as the starting cold rolled steel sheets. However, this practice has the following two problems.

(1) Inconsistency in the steel quality in the lengthwise direction causes the lowering of the yield.

(2) Great difficulties in acid pickling lowers the production efficiency.

In order to avoid these problems, it is necessary to coil the hot rolled steel sheets at lower temperatures, and in order to maintain the desired formability despite the lower temperature coiling, the following steel compositions and the hot rolling conditions should preferably be maintained.

First, desirable steel compositions will be described. For the lower temperature coiling, the carbon content must be in the range from 0.01 to 0.02%. Carbon contents exceeding 0.02% lower the $\bar{r}$ value of the final products and also harden the steel. These adverse effects are attributed to the following phenomena which take place in the steels containing more than 0.02% carbon.

(1) During the cooling step after the hot rolling up to the coiling, the pearlite transformation is predominant and the cementite cannot coagulate.

(2) Even with the manganese content is maintained lower than 0.15%, the Mn-C complexes which hinder the deep-drawbility will be present during the annealing, which will prevent the development of the {111} annealing texture, and also render the grain size finer, hence lowering the $\bar{r}$ value and hardening the steel.

On the other hand, if the carbon content is less than 0.01%, the degree of carbon in supersaturation is not enough and a relatively large amount of carbon in solid solution will be present after the continuous galvanizing annealing process so that the desired non-strain-aging cannot be obtained.

Silicon will harden the steel sheets remarkably, cause coating defects and restrict the alloying reaction. Therefore, the upper limit of the silicon content is set to 0.3%.

The manganese content is critical to the lower temperature coiling in association with the carbon content. First for preventing the hot embrittlement, the manganese content is maintained not less than 0.03%. With the manganese content more than 0.15%, on the other hand, the cementite in the hot rolled steel sheets can hardly grow and coagulate during the lower temperature coiling despite the carbon content maintained not more than 0.02%, and the concentration of the Mn-C complexes will increase during the annealing and hence the resultant $\bar{r}$ value lowers and the steel hardens.

On the other hand, if the manganese content is less than 0.15%, the number of MnS which plays an important role as the nucleation site of the cementite in the grains during the overaging step increases remarkably. Thus the lowering of the manganese content produces very advantageous effect for the non-aging property.

The phosphorus content, which remarkably increases the yield strength of the steel sheets, is limited to 0.02% as the upper limit.

The sulfur content, which is effective to prevent the hot embrittlement of the low manganese steel and prevent the hardening of the steel, is limited to 0.015% as the upper limit.

Aluminum and nitrogen just as carbon and manganese, are important for the performing the lower temperature coiling. From the view points of improving the $\bar{r}$ values and lowering the yield point value, the upper limit of the nitrogen content is 0.003%. Despite such a low nitrogen steel, it is necessary to precipitate AlN fairly enough to maintain the desired formability by the lower temperature coiling, and for this purpose the aluminum content must be 0.04% or more. On the other hand an excessive aluminum addition will cause the undesirable hardening of the steel sheets and restrict the alloying reaction. For these reasons the upper limit of the aluminum content is 0.10%.

The hot rolling conditions are very important when the steel sheets of the composition described just above are used, and the following conditions are preferable.

First, the steel slabs are subjected to the soaking at the temperature defined below.

$$950^\circ\ C. \leqq ST \leqq 7Mn/S + 1050^\circ\ C. \quad (1)$$

and then subjected to the hot rolling. The finishing temperature should be not lower than Ar3 and the coiling should be done in the temperature range from 600° to 700° C.

The reason for defining the slab re-heating temperature as above are set forth below.

The starting steel sheets used in the present invention, in the case that the low temperature coiling is employed, have a low manganese content as compared with the conventional steel sheets in order to maintain the desired formability. The problem in this case is the occurrence of hot-shortness in the edge portions of the hot rolled steel sheets, and for preventing the occurrence of hot-shortness, it has been found through extensive studies that the low slab re-heating temperature as defined by the formula (1) is very effective. Therefore the upper limit of the slab re-heating temperature should be controlled according to the right term of the formula (1). On the other hand, the lower limit depends on the hot rolling mill, but it is the lowest temperature that can maintain the finishing temperature not lower than the Ar3 point and is 950° C. in the present invention.

The reason why the boundary of the occurrence of hot-shortness is determined by the formula (1) can be explained as below.

In cases of the low manganese steels, when heated at high temperatures, the manganese can no more fix the sulfur fully so that sulfur not fixed by manganese as MnS is present predominantly in the austenite grain boundaries, thus allowing an extremely high local concentration of sulfur and causing the eutectic reaction of Fe (molten iron containing a large amount of sulfur in solid solution) $\rightarrow \gamma Fe + FeS$ at 988° C. Therefore at temperatures higher than 988° C., a liquid film is formed in the austensite grain boundaries, and the embrittlement due to the liquid film is caused.

It has also been newly found by the present inventors that in cases of the high aluminum steel sheets as used in the present invention, AlN will precipitate around the nuclei of MnS during the low temperature heating of slabs so far as the low temperature slab re-heating of the formula (1) is applied, and that these complex precipitates are larger in size than the AlN which is conventionally taught to precipitate solely so that they will not hinder the grain growth during the annealing. This assures the improved formability of the annealed steel sheets despite the low temperature coiling.

The coiling temperature is also one of the main features of the present invention. When the coiling temperature exceeds 700° C., the material quality deteriorates, particularly at the inner most portion and the outer most portion of the coils, thus lowering the production yield, and the descalability becomes very bad. On the other hand, if the coiling temperature is below 600° C., the desired AlN precipitation and the desired coagulation and growth of the cementite cannot be obtained. For these reasons the lower limit of the coiling temperature is 600° C.

Regarding the cold rolling, the conventional practice may be applied, but it is preferable that the reduction rate is not less that 40%, because the reduction rate below this, the desired $\bar{r}$ value cannot be obtained.

When high-strength galvanized steel sheets having a strength of 35 to 45 Kgf/mm$^2$ is to be produced according to the present invention, ordinary low carbon Al-killed cold rolled steel sheets containing phosphorus are used and their compositions are defined as below.

The carbon content should be in the range from 0.01 to 0.04% by weight, because carbon contents less than 0.01% are not effective to obtain the desired non-strain-aging property, and do not produce enough strength of the steel sheets, while carbon contents exceeding 0.04% harden the steel sheets excessively and lower the $\bar{r}$ value, thus failing to provide satisfactory formability.

The silicon content is limited to 0.5% as the upper limit, because silicon impairs the coating adhesion, thought it can increase the strength of the steel sheets.

The manganese content, when present in an amount less than 0.03%, cannot fully prevent the hot embrittlement due to sulfur, and when present in an amount exceeding 0.40%, deteriorates the formability. Further the number of MnS which acts as the nucleation site of the cementite precipitation during the overaging treatment decreases remarkably at the manganese content of 0.40%. This is disadvantageous for achieving the non-strain-aging property.

Phosphorus is a very important element in the present invention. With the phosphorus content less than 0.020%, it is difficult to maintain the strength of 35 Kgf/mm$^2$, and on the other hand with the phosphorus content beyond 0.13%, the strength largely exceeds 45 Kgf/mm$^2$ and the weldability, secondary non-embrittlement after press forming and surface treatability deteriorate.

The sulfur content is restricted to an upper limit of 0.02% for the purpose of preventing the hot embrittlement.

When aluminum is present in an amount less than 0.02%, it is difficult to fully precipitate AlN which hinders the grain growth during the annealing step so as to eliminate its adverse effect before the cold rolling. On the other hand when the aluminum content exceeds 0.10%, AlN is fully precipitated but the production cost increases.

Nitrogen, when present in an amount more than 0.007%, causes an increased amount of AlN which hinders the grain growth during the annealing step and deteriorates the deep-drawability.

The present invention will be more clearly understood from the following description of the embodiments of the present invention.

PREFERRED EMBODIMENTS OF THE INVENTION

EXAMPLE 1

The steel having the chemical composition shown in Table 1 was prepared in a converter and continuously cast into steel slabs. These slabs were heated to 1080° C., hot rolled to a thickness of 4.0 mm with a finishing temperature of 895° C., then cooled on a run-out table at an average cooling rate of 20° C./s and coiled at 720° C. After acid pickling, the sheets were cold rolled to a thickness of 0.8 mm, then subjected to the continuous galvanizing treatment and the alloying treatment in the production line of in-line annealing type as shown in FIGS. 1(*a*) and 1(*b*). The resultant sheets were given 1.0% temper rolling to obtain test pieces.

For the tensile tests, test pieces were prepared according to JIS Z 2201, No. 5 test piece, and the tests were conducted according to JIS Z 2241.

In this example, the effects on the non-strain-aging and BH properties by the cooling rate ($\beta_1$) and the finishing temperature ($T_E$) of the cooling in the heat cycles shown in FIGS. 1(*a*) and 1(*b*) are illustrated. Here, the reheating rate, $\alpha$, $\alpha_1$, and $\alpha_2$ is 50° C./s, the cooling rate ($\beta_2$) after the galvanizing step is 50° C./s, and the finishing temperature ($T_S$) is 350° C.

The non-strain-aging property is evaluated by measuring YP-El after the temper rolling and the artificially accelerated aging at 100° C. for 60 minutes, and it has been found that if the YP-El value is not more than 0.2%, the desired non-strain-aging properly can be achieved both for the galvanized steel sheets and the galvannealed steel sheets as well.

For evaluation of the BH property, the test pieces are given 2% preliminary tension strain, subjected to a heat treatment corresponding to the paint baking at 170° C. for 20 minutes, and again subjected to tensile tests, and the BH property is evaluated by the value obtained by subtracting the nominal stress before the heat treatment from the yield strength after the heat treatment.

Figure 3A:
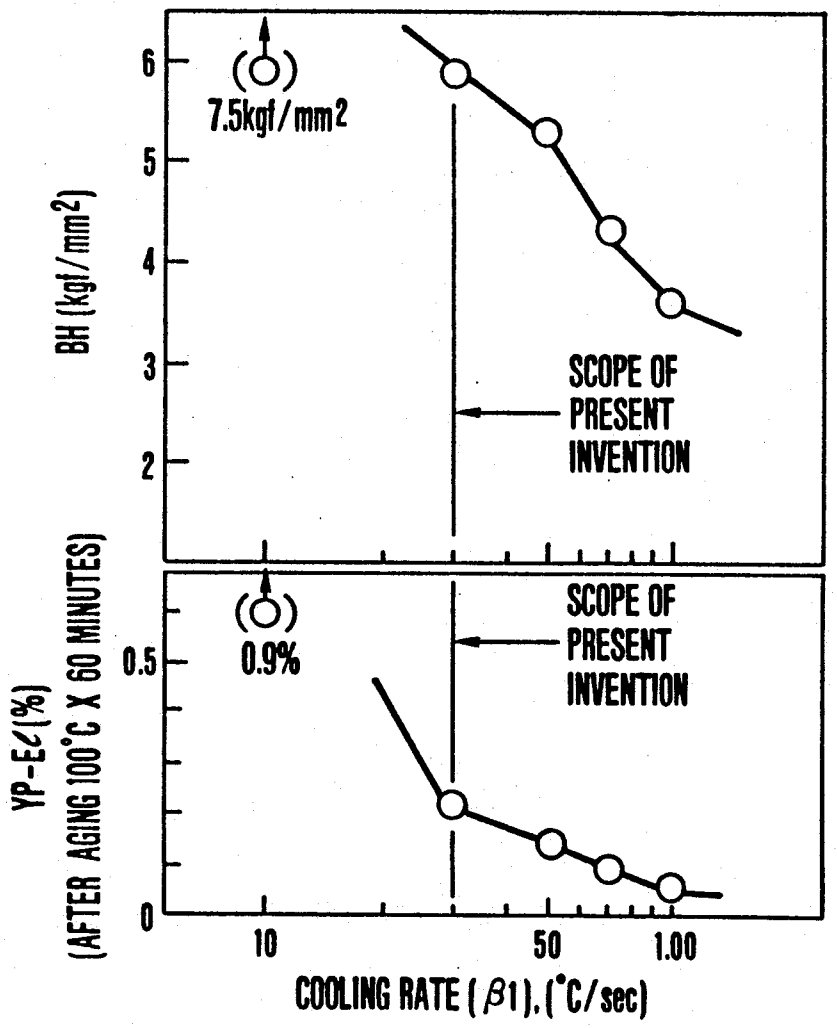
FIGS. 3(*a*) and 3(*b*) and FIGS. 4(*a*) and 4(*b*) show the effects on the BH and YP-El by the cooling rate (in FIG. 1) and the finishing temperature ($T_E$) of the rapid cooling.
Figure 3B:
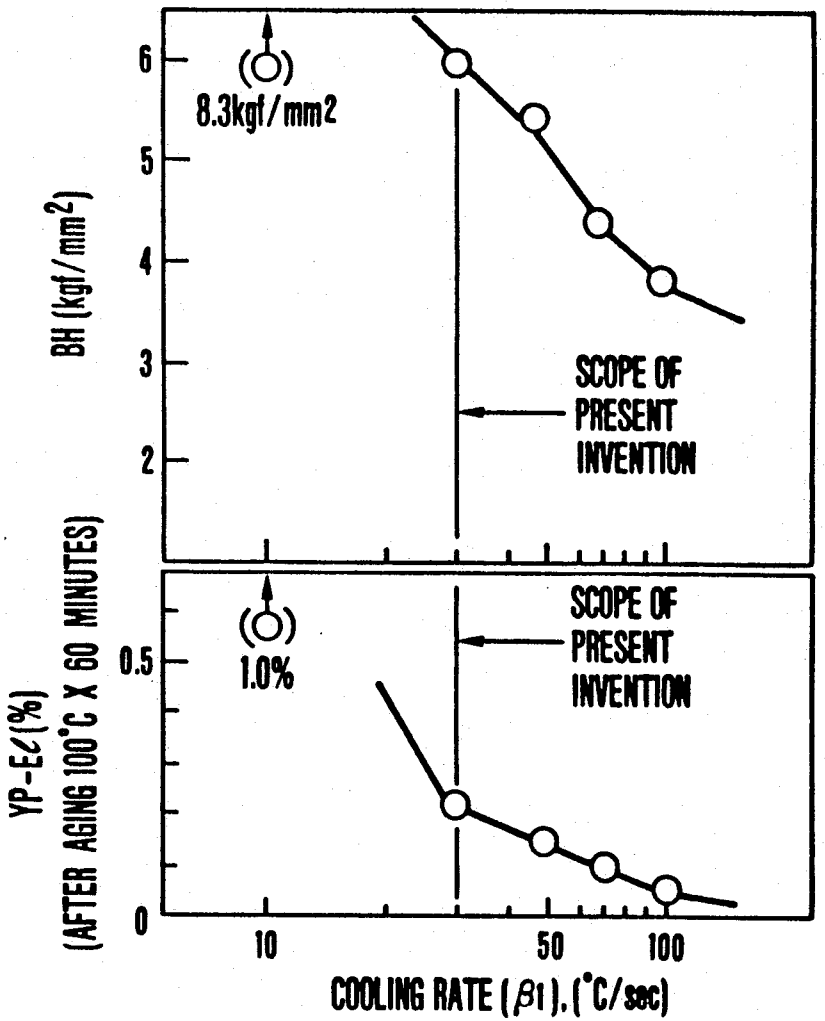
Figure 4B:
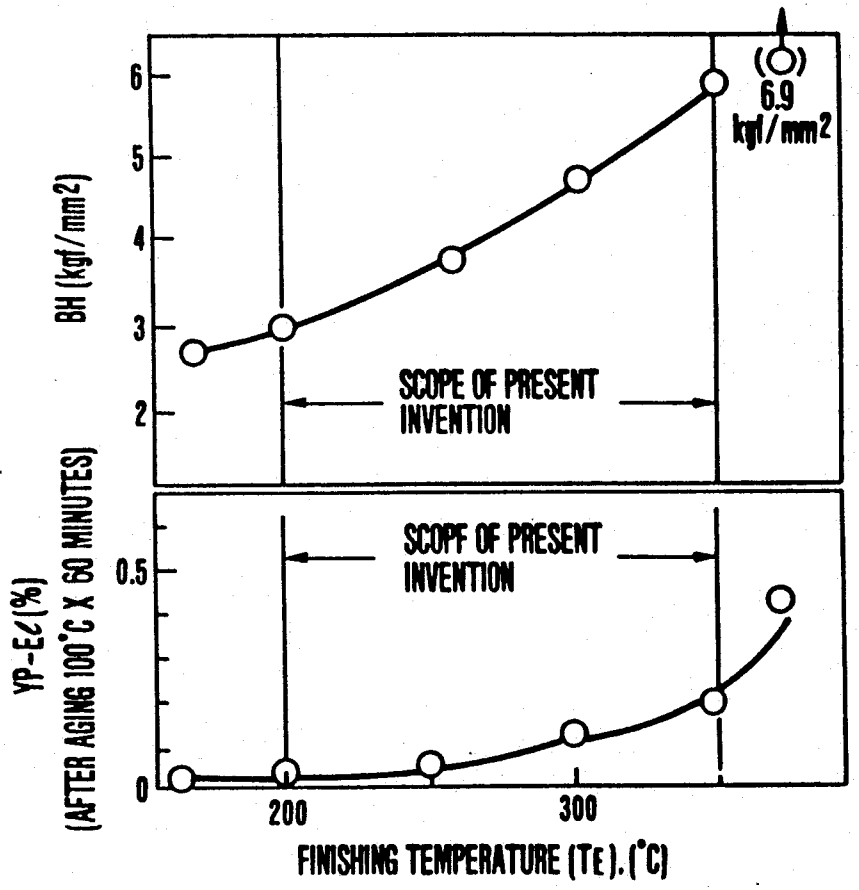
Figure 4A:
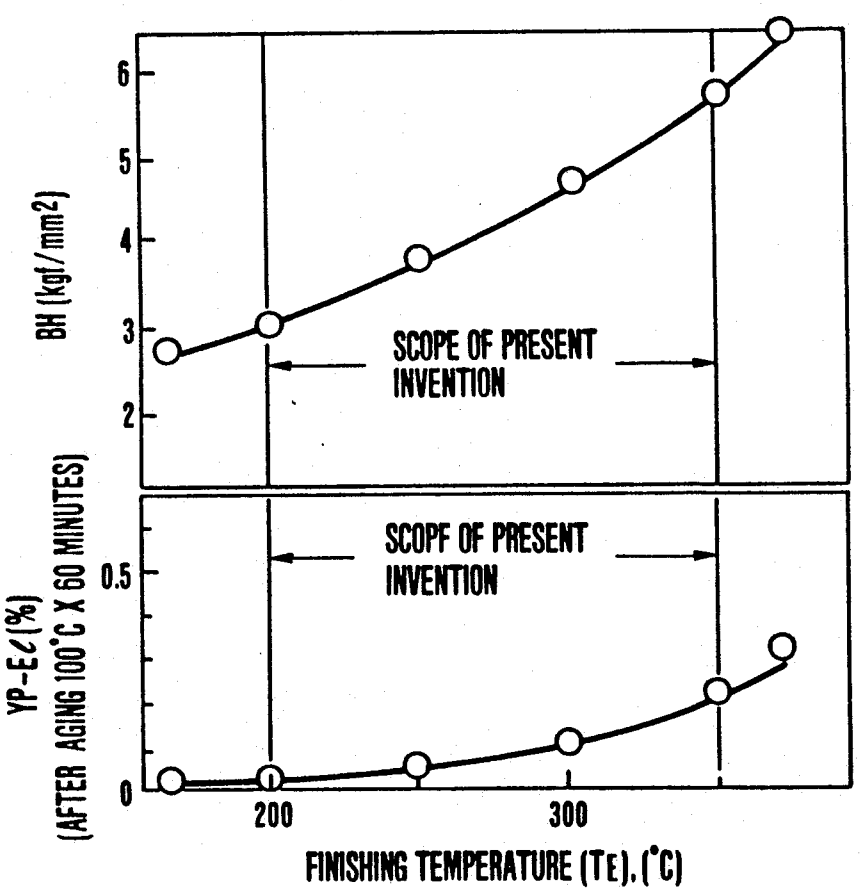

The test results are shown in FIGS. 3(*a*), 3(*b*) and FIGS. 4(*a*) and 4(*b*).

As clearly understood from FIGS. 3(*a*) and 3(*b*), if the overaging time ($t_{OA}$ in FIG. 1) is limited to 120 seconds which causes no problems for a commercial production, it is necessary to apply a rapid cooling with the cooling rate ($\beta_1$) not less than 30° C./s in order to achieve the desired non-strain-aging property (YP-El$\leqq$0.2%) irrespective of the alloying treatment when the finishing temperature is 250° C. Under these conditions, the BH property becomes 3 Kgf/mm$^2$ or higher.

The effects of the finishing temperature ($T_E$) are shown in FIGS. 4(*a*) an 4(*b*) where $\beta_1$ is 100° C./s.

As understood from these figures, in order to satisfy the conditions of YP-El$\leqq$0.2% and BH$\leqq$3 Kgf/mm$^2$, the finishing temperature ($T_E$) must be maintained in the range from 200° to 350° C., irrespective of the alloying treatment. If the temperature is lower than 200° C., not only the amount of BH becomes insufficient, but also the number of the carbides in the grains increases excessively to raise the yield strength to 21 Kgf/mm$^2$ or higher, resulting in increased hardness of the steel sheets. Further the energy cost for the rapid cooling and reheating increases. Meanwhile if the temperature $T_E$ is higher than 350° C., the desired non-aging property can no more be obtained.

EXAMPLE 2

Steel strips having the chemical compositions and hot and cold rolling histories as shown in Table 2 were subjected to the continuous galvanizing treatment and the continuous galvannealing treatments as shown in FIGS. 1(*a*) and 1(*b*), and then subjected to 1.0% temper rolling.

In this example, the effects on the product surface quality by the temperature ($T_S$) at which the strips contact the hearth rolls for the first time after the continuous galvanizing treatment with or without the alloying treatment, and the effects on the non-strain-aging property and the BH property by the temperature ($T_S$) and the overaging time ($t_{OA}$) are illustrated.

Thus in this example, the cooling rate $\beta_1$ is 100° C./s, the finishing temperature ($T_E$) of the rapid cooling is 250° C., the holding time at the temperature is one second, and the reheating rate $\alpha$, $\alpha_1$ and $\alpha_2$ is 50° C./s, and the factors $T_S$ and $t_{OA}$ were varied. The surface quality was evaluated carefully by naked eyes and graded as satisfactory (O) if there is no defects caused by the zinc adhering on the rolls, and graded as unsatisfactory (X) if there are the defects. The non-strain-aging property and the BH property were evaluated in the same way as in Example 1.

The test results are shown in Table 3. No. 8 in the table shows the properties of the steel strip treated by the conventional heat cycle (the dotted line in FIG. 1) for comparison. No. 1 to No. 4 show the effects of $T_S$. It is shown that a satisfactory surface quality free from the defects can be obtained by maintaining Ts not higher than 370° C., irrespective of the alloying treatment. No. 5 to No. 7 show the effects of the overaging time ($t_{OA}$) and it is shown that the desired non-strain-aging property as well as the desired BH property can be obtained by the overaging time not shorter than 40 seconds.

treatment according to the present invention on the laboratory scale.

The heat cycles applied in this example were standard ones. Thus in the heat cycles shown in FIGS. 1(*a*) and 1(*b*), the cooling rate $\beta_1$ was 100° C., the finishing temperature $T_E$ of the rapid cooling was 250° C., the holding time at this temperature was 2 seconds, the reheating rate $\alpha$, $\alpha_1$, and $\alpha_2$ was 50° C./s, the hearth roll contacting temperature $T_S$ was 350° C., and the overaging time $t_{OA}$ was 150 seconds. The thus obtained sheets were given 1.0% temper rolling and subjected to the tests.

For the tensile tests, the test pieces were prepared according to No. 5 test piece of JIS Z 2201, and the tests

TABLE 2

Chemical Composition (wt. %) and Hot and Cold Rolling Conditions of Standard Steel Sheets Used in the Invention

| C | Si | Mn | P | S | Al | N | SRT (°C.) | Ft (°C.) | CT (°C.) | CR (%) | t (mm) |
|---|---|---|---|---|---|---|---|---|---|---|---|
| 0.016 | 0.02 | 0.11 | 0.009 | 0.006 | 0.063 | 0.0018 | 1110 | 905 | 660 | 80.0 | 0.7 |

SRT: Slab re-heating temperature
FT: Finishing temperature of hot rolling
CT: Coiling temperature of hot-rolled band
CR: Cold rolling reduction rate
t: Thickness of cold rolled steel sheet

TABLE 3

Conditions of Galvanizing and Overaging Treatments and Resultant Steel Sheet Qualities and Properties (after artifical aging 100° C. × 60 minutes)

Figure 1B:
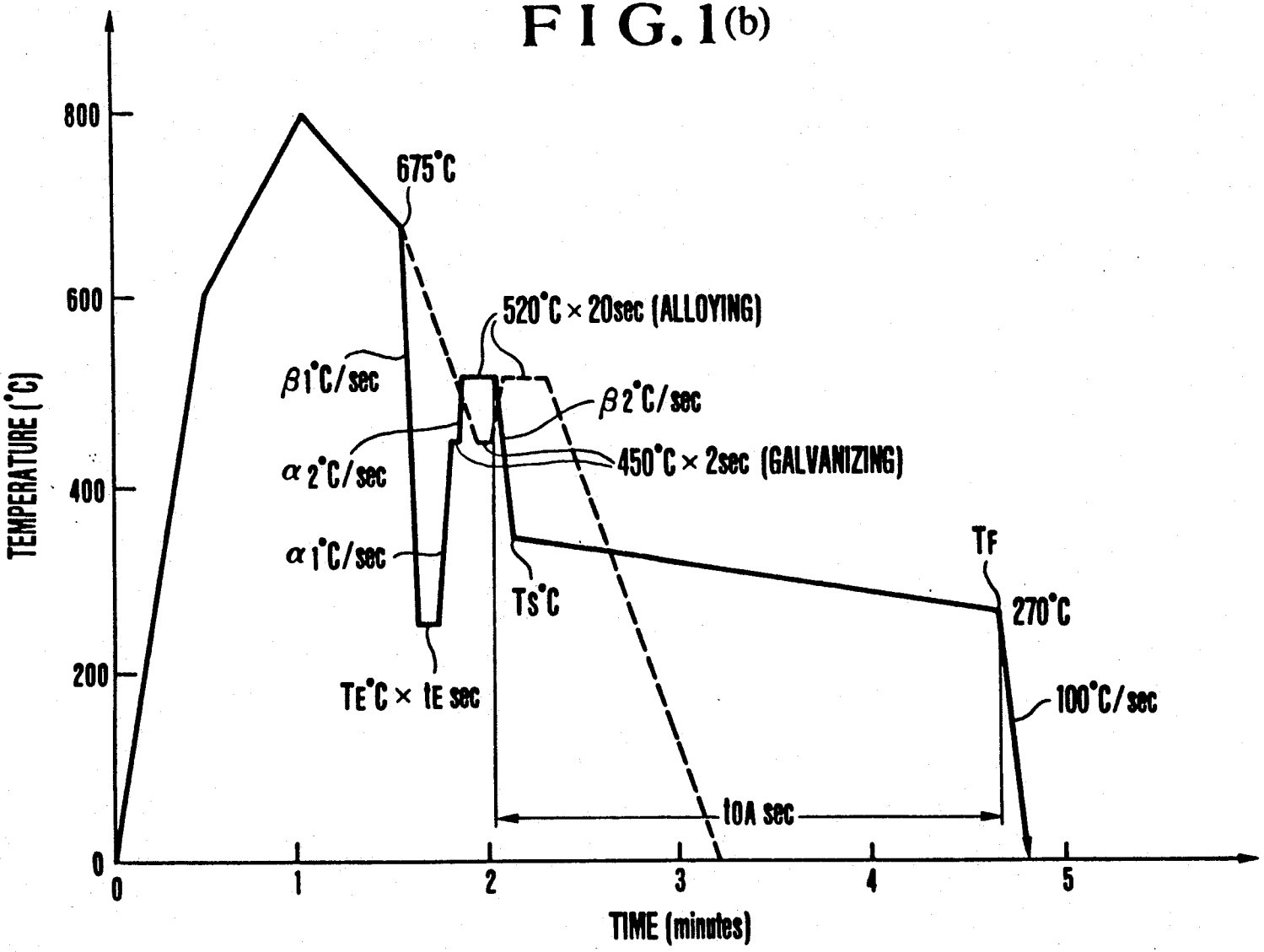

| No | Heat Treatment Conditions (FIG. 1(a), 1(b))*1 | Galvanized Steel Sheets: Surface Qualities | YP (kgf/mm²) | El (%) | $\bar{r}$ | YP−El (%) | BH (kgf/mm²) | Residual Solid Solution C (ppm) | Remarks |
|---|---|---|---|---|---|---|---|---|---|
| 1 | $T_S$ = 420° C., $t_{OA}$ = 150 sec | X | 20.3 | 43.0 | 1.79 | 0.3 | 5.9 | 7.1 | Comparison |
| 2 | $T_S$ = 380° C., $t_{OA}$ = 150 sec | X | 19.1 | 44.3 | 1.75 | 0.3 | 5.8 | 6.9 | Comparison |
| 3 | $T_S$ = 350° C., $t_{OA}$ = 150 sec | ○ | 17.8 | 46.1 | 1.83 | 0 | 3.4 | 2.9 | Invention |
| 4 | $T_S$ = 300° C., $t_{OA}$ = 150 sec | ○ | 18.8 | 44.9 | 1.82 | 0.1 | 4.6 | 4.7 | Invention |
| 5 | $T_S$ = 350° C., $t_{OA}$ = 20 sec | ○ | 22.1 | 39.9 | 1.79 | 0.6 | 7.0 | 9.8 | Comparison |
| 6 | $T_S$ = 350° C., $t_{OA}$ = 40 sec | ○ | 19.4 | 44.1 | 1.85 | 0.2 | 5.5 | 5.0 | Invention |
| 7 | $T_S$ = 350° C., $t_{OA}$ = 180 sec | ○ | 17.2 | 46.8 | 1.78 | 0 | 3.0 | 2.1 | Invention |
| 8 | Conventional (the heat cycle shown by the dotted line in FIG. 1) | ○ | 28.9 | 34.5 | 1.79 | 2.1 | 8.3 | 11.5 | Comparison |

| No | Heat Treatment Conditions (FIG. 1(a), 1(b))*1 | Galvannealed Steel Sheets: Surface Qualities | YP (kgf/mm²) | El (%) | $\bar{r}$ | YP−El (%) | BH (kgf/mm²) | Residual Solid Solution C (ppm) | Remarks |
|---|---|---|---|---|---|---|---|---|---|
| 1 | $T_S$ = 420° C., $t_{OA}$ = 150 sec | X | 21.1 | 41.9 | 1.78 | 0.4 | 6.3 | 9.0 | Comparison |
| 2 | $T_S$ = 380° C., $t_{OA}$ = 150 sec | X | 19.5 | 43.2 | 1.84 | 0.3 | 6.0 | 7.2 | Comparison |
| 3 | $T_S$ = 350° C., $t_{OA}$ = 150 sec | ○ | 18.4 | 45.8 | 1.82 | 0 | 4.1 | 3.9 | Invention |
| 4 | $T_S$ = 300° C., $t_{OA}$ = 150 sec | ○ | 18.9 | 44.2 | 1.79 | 0.1 | 4.7 | 4.5 | Invention |
| 5 | $T_S$ = 350° C., $t_{OA}$ = 20 sec | ○ | 22.5 | 38.3 | 1.82 | 0.7 | 7.5 | 10.9 | Comparison |
| 6 | $T_S$ = 350° C., $t_{OA}$ = 40 sec | ○ | 19.6 | 44.0 | 1.83 | 0.2 | 5.8 | 5.5 | Invention |
| 7 | $T_S$ = 350° C., $t_{OA}$ = 180 sec | ○ | 17.8 | 45.2 | 1.78 | 0 | 3.2 | 2.5 | Invention |
| 8 | Conventional (the heat cycle shown by the dotted line in FIG. 1) | ○ | 29.5 | 32.3 | 1.77 | 3.0 | 8.5 | 12.3 | Comparison |

*1In FIGS. 1(a), 1(b), $\beta_1$ = 100° C./s, $T_E$ = 250° C., $t_E$ = 1 second, $\alpha$, $\alpha_1$ and $\alpha_2$ are 50° C./s

EXAMPLE 3

Steels having the chemical compositions shown in Table 4 were prepared in a convertor and continuously cast into slabs, heated to a temperature ranging from 1050° to 1100° C., hot rolled to a thickness of 4.0 mm with a finishing temperature ranging from 880° to 920° C., cooled on the run out table with an average cooling rate of 20° C./s and coiled at a temperature ranging from 660° to 680° C. For comparison, the coiling was done at 580° C. also. After acid picking, the sheets were cold rolled to 0.8 mm, and were subjected to silimated continuous galvanizing treatment and the galvannealing were conducted according to JIS Z 2241. The $\bar{r}$ value was an average value obtained with 15% tension strain. The aging property was evaluated by measuring YP-El after the artificial aging at 100° C. for 60 minutes. The BH property was evaluated by the same method as in Example 1.

The test results are shown in Table 4, in which the steels A, E, G, and K are the galvanized and galvannealed steel sheets according to the present invention, and these sheets show the non-strain-aging property and are hardenable by the baking and has excellent press formability.

Meanwhile the steel B, though having the same chemical composition as the steel A of the present invention, shows inferior press formability due to the excessively low coiling temperature, and does not show the non-strain-aging property due to the strain aging caused by the solid solution carbon. The steel C, due to the excessively low carbon content, is inferior in the non-strain-aging property and the ductility even if the continuous galvanizing treatment with the overaging heat cycle according to the present invent is applied. On the other hand, however, if the carbon content is excessively high as in the steel D, the press formability deteriorates though the desired non-strain-aging property is obtained. The steel F, due to the excessively high manganese content, is inferior in the press formability. The steel H, due to the excessively low aluminum content, is inferior in the press formability and shows remarkable strain aging caused by the carbon in solid solution. On the other hand, the steel I having a too high aluminum content is hard and inferior in the ductility. And the steel N, due to the excessively high nitrogen content, shows inferior press formability.

As described above, the present invention can assure the desired properties by appropriately adjusting the chemical composition despite the low temperature coiling, and can eliminate the various problems accompanying the conventional high temperature coiling. In these aspects, the present invention provides significant advantages.

TABLE 4

Chemical Compositions (wt. %) and Resultant Steel Sheet Qualities (after artifical aging 100° C. × 60 minutes)

| Steel | C | Si | Mn | P | S | Al | N | CT (°C.) | Remarks | Galvanized Steel Sheets YP (kgf/mm²) | El (%) | $\bar{r}$ | YP−El (%) | BH (kgf/mm²) | Residual Solid Solution (ppm) |
|---|---|---|---|---|---|---|---|---|---|---|---|---|---|---|---|
| A | 0.016 | 0.02 | 0.10 | 0.009 | 0.007 | 0.065 | 0.0018 | 670 | Invention | 17.9 | 47.2 | 1.82 | 0 | 3.5 | 3.8 |
| B | 0.016 | 0.02 | 0.10 | 0.009 | 0.007 | 0.065 | 0.0018 | 580 | Comparison | 20.7 | 42.1 | 1.14 | 0.3 | 5.8 | 7.0 |
| C | 0.009 | 0.02 | 0.13 | 0.010 | 0.008 | 0.071 | 0.0016 | 680 | Comparison | 18.2 | 43.8 | 1.87 | 0.8 | 7.3 | 10.8 |
| D | 0.026 | 0.02 | 0.12 | 0.011 | 0.005 | 0.058 | 0.0017 | 680 | Comparison | 21.1 | 43.3 | 1.32 | 0 | 3.2 | 2.3 |
| E | 0.018 | 0.01 | 0.13 | 0.008 | 0.006 | 0.068 | 0.0015 | 660 | Invention | 18.5 | 45.8 | 1.77 | 0 | 3.3 | 2.8 |
| F | 0.015 | 0.01 | 0.21 | 0.009 | 0.008 | 0.072 | 0.0014 | 680 | Comparison | 21.2 | 42.8 | 1.20 | 0.2 | 5.1 | 5.0 |
| G | 0.015 | 0.03 | 0.08 | 0.011 | 0.005 | 0.071 | 0.0025 | 660 | Invention | 17.8 | 46.8 | 1.88 | 0 | 4.3 | 4.4 |
| H | 0.016 | 0.02 | 0.10 | 0.010 | 0.006 | 0.021 | 0.0019 | 660 | Comparison | 20.8 | 41.3 | 1.21 | 0.5 | 6.7 | 9.3 |
| I | 0.018 | 0.02 | 0.12 | 0.009 | 0.009 | 0.152 | 0.0022 | 660 | Comparison | 20.3 | 43.5 | 1.65 | 0 | 3.2 | 2.4 |
| J | 0.014 | 0.01 | 0.13 | 0.011 | 0.010 | 0.063 | 0.0038 | 660 | Comparison | 21.2 | 41.5 | 1.20 | 0.4 | 6.3 | 9.0 |
| K | 0.013 | 0.03 | 0.14 | 0.011 | 0.011 | 0.075 | 0.0026 | 670 | Invention | 18.1 | 46.3 | 1.72 | 0.1 | 5.0 | 5.0 |

| Steel | Galvannealed Steel Sheets YP (kgf/mm²) | El (%) | $\bar{r}$ | YP−El (%) | BH (kgf/mm²) | Residual Solid Solution (ppm) | Remarks |
|---|---|---|---|---|---|---|---|
| A | 18.1 | 46.8 | 1.80 | 0 | 3.6 | 3.9 | Invention |
| B | 21.2 | 40.8 | 1.10 | 0.3 | 5.8 | 7.1 | Comparison |
| C | 18.6 | 41.3 | 1.85 | 0.9 | 7.8 | 12.5 | Comparison |
| D | 22.0 | 41.9 | 1.25 | 0 | 3.3 | 2.5 | Comparison |
| E | 18.7 | 45.2 | 1.73 | 0 | 3.5 | 3.0 | Invention |
| F | 21.5 | 41.7 | 1.20 | 0.2 | 5.2 | 5.1 | Comparison |
| G | 18.3 | 46.2 | 1.84 | 0.1 | 4.5 | 4.6 | Invention |
| H | 21.1 | 41.2 | 1.20 | 0.7 | 6.9 | 9.8 | Comparison |
| I | 20.7 | 42.8 | 1.58 | 0 | 3.5 | 3.0 | Comparison |
| J | 21.5 | 41.1 | 1.20 | 0.5 | 6.5 | 9.4 | Comparison |
| K | 18.6 | 46.0 | 1.71 | 0.1 | 5.1 | 5.3 | Invention |

EXAMPLE 4

A vacuum melted low carbon Al-killed steel having a chemical composition: 0.016% carbon; 0.01% Si; 0.02 to 0.25% Mn; 0.009% P; 0.007% S; 0.066% Al; and 0.0017% N, with the Mn/S ration ranging from 3 to 36 was soaked at a temperature ranging from 1050° to 1250° C. for one hour, hot rolled and cooled to the room temperature. The finishing temperature of the hot rolling was not lower than 910° C., and the final sheet thickness was 4.0 mm. The occurrence of edge crackings appearing on the hot rolled sheets thus obtained was investigated in details.

FIG. 5 shows the effects of the hot rolling temperature and the Mn/S ratio on the occurrence of edge crackings. As clearly understood from the figure, when the hot rolling temperature (ST) satisfies the condition:

$$ST \leqq 7Mn/S + 1050° C.$$

the occurrence of edge cracking can be avoided even if the manganese content lowers.

EXAMPLE 5

A cold rolled steel strip having the chemical composition and the hot rolling and cold rolling histories as shown in Table 5 was subjected to simulated galvanizing treatment and galvannealing treatment as shown in FIG. 1 on a laboratory scale, and then to 1.0% temper rolling.

In this example the heat cycle shown in FIG. 1 was applied, in which the cooling rate was 100° C./s, the finishing temperature $T_E$ of the rapid cooling was 250° C. without holding at the temperature, the reheating rate $\alpha$, $\alpha_1$ and $\alpha_2$ was 50° C./s, the cooling rate $\beta_2$ after the galvanizing and galvannealing was 50° C./s, the hearth roll contacting temperature $T_S$ was 350° C., and the overaging time was varied to 20 seconds and 150 seconds.

For comparison, the conventional heat cycle shown by the dotted line in FIG. 1 was also applied.

The properties of the final products thus obtained are shown in Table 6. The steel No. 1 obtained according to the present invention shows a strength of 40 Kgf/mm$^2$ order, a non-aging property, and satisfactory BH property and press formability. In the case of the steel No. 2, wherein the overaging time was relatively short as 20 seconds, the non-strain-aging property is inferior, and also in the case of the comparative product obtained by the conventional heat cycle is also inferior in the aging property.

TABLE 5

Chemical Composition (wt. %) and Hot and Cold Rolling Conditions of Standard P-containing Low-Carbon Al-Killed Steel Sheets Used in the Invention

| C | Si | Mn | P | S | Al | N | SRT (°C.) | Ft (°C.) | CT (°C.) | CR (%) | t (mm) |
|---|---|---|---|---|---|---|---|---|---|---|---|
| 0.017 | 0.02 | 0.10 | 0.07 | 0.007 | 0.059 | 0.0015 | 1100 | 930 | 700 | 80 | 0.8 |

SRT: Slab re-heating temperature
FT: Finishing temperature of hot rolling
CT: Coiling temperature of hot-rolled band
CR: Cold rolling reduction rate
t: Thickness of cold rolled steel sheet

TABLE 6

Qualities and Properties of Galvanized High-Strength Cold Rolled Steel Sheets

Galvanized Steel Sheets

| No | Heat Treatment Conditions (FIG. 1(a), 1(b)) | Surface Qualities | TS (kgf/mm$^2$) | YP (kgf/mm$^2$) | El (%) | $\bar{r}$ | YP—El (%) | BH (kgf/mm$^2$) | Residual Solid Solution C (ppm) | Remarks |
|---|---|---|---|---|---|---|---|---|---|---|
| 1 | $T_S$ = 350° C., $t_{OA}$ = 150 sec | ○ | 40.6 | 23.8 | 39.0 | 1.64 | 0 | 3.5 | 3.7 | Invention |
| 2 | $T_S$ = 350° C., $t_{OA}$ = 20 sec | ○ | 50.1 | 30.1 | 28.1 | 1.18 | 0.8 | 7.9 | 20.3 | Comparison |
| 3 | Conventional | ○ | 51.5 | 30.8 | 31.6 | 1.69 | 2.4 | 8.2 | 21.7 | Conventional |

Galvannealed Steel Sheets

| No | Heat Treatment Conditions (FIG. 1(a), 1(b)) | Surface Qualities | TS (kgf/mm$^2$) | YP (kgf/mm$^2$) | El (%) | $\bar{r}$ | YP—El (%) | BH (kgf/mm$^2$) | Residual Solid Solution C (ppm) | Remarks |
|---|---|---|---|---|---|---|---|---|---|---|
| 1 | $T_S$ = 350° C., $t_{OA}$ = 150 sec | ○ | 41.0 | 24.1 | 37.9 | 1.63 | 0 | 4.2 | 4.7 | Invention |
| 2 | $T_S$ = 350° C., $t_{OA}$ = 20 sec | ○ | 51.0 | 30.5 | 27.8 | 1.15 | 0.8 | 8.1 | 21.1 | Comparison |
| 3 | Conventional | ○ | 53.4 | 31.9 | 30.2 | 1.70 | 3.1 | 8.4 | 23.5 | Conventional |

As understood from the foregoing descriptions the present invention enables the production of galvanized steel sheets and galvannealed steel sheets which are non-aging, hardenable by baking, and have excellent press formability as well as surface quality without any special requirements in the steel making process in a continuous galvanizing line of in-line annealing type so that the advantages inherent to the continuous galvanizing process, namely the consistent sheet quality, high production efficiency, savings of energy and labor, and short-period production can be achieved, thus producing great industrial advantages.

Lastly the present invention may be advantageously applied to production processes for surface treated steel sheets as aluminum coated steel sheets other than the galvanized steel sheets.

What is claimed is:

1. A process for producing a non-aging galvanized steel sheet having good formability in a continuous galvanizing production line, which comprises heating a low carbon, Al-killed cold rolled steel sheet at a temperature not lower tan a recrystallizing temperature, reducing the surface of the steel sheet thus heated in a reducing atmosphere, cooling the steel sheet to a temperature ($T_E$) ranging from 200° to 350° C. from a temperature not lower than 600° C. at a cooling rate not less than 30° C./s, holding the steel sheet at the temperature ($T_E$) for 0 to less than 10 seconds, reheating the steel sheet to a temperature ranging from 430° to 500° C. at a heating rate not less than 10° C./s, immersing the steel sheet into a molten zinc bath, cooling the steel sheet thus galvanized to a temperature not higher than 370° C., and subjecting the steel sheet to an overaging treatment to a temperature range from 250° to 320° C. for not shorter than 40 seconds, the said low carbon, Al-killed cold rolled steel sheet being obtained by soaking a steel slab containing by weight 0.01 to 0.02% carbon, not more than 0.3% silicon, 0.03 to 0.15% manganese, not more than 0.02% phosphorus, not more than 0.015% sulfur, 0.04 to 0.10% aluminum, and not more than 0.003% nitrogen, with the balance being iron and unavoidable impurities to a temperature satisfying the condition of $$950° C. \leqq ST \leqq 7Mn/S + 1050° C.$$

hot rolling the slab with a finishing temperature not lower than Ar3, coiling the hot rolled steel sheet at a temperature ranging from 600° to 700° C., and cold rolling the steel sheet.

2. A process for producing a non-aging galvannealed steel sheet having good formability in a continuous galvanizing production line, which comprises heating a low carbon, Al-killed cold rolled steel sheet at a temperature not lower than a recrystallizing temperature, reducing the surface of the steel sheet thus heated in a reducing atmosphere, cooling the steel sheet to a temperature ($T_E$) ranging from 200° to 350° C. from a temperature not lower than 600° C., at a cooling rate not less than 30° C./s, holding the steel sheet at the temperature ($T_E$) for 0 to less than 10 seconds, reheating the steel sheet to a temperature ranging from 430° to 500° C. at heating rate not less than 10° C./s, immersing the steel sheet into a molten zinc bath, reheating the steel sheet thus galvanized to a temperature ranging from 480° to 600° C. at a heating rate not less than 10° C./s, alloying the zinc coating layer of the steel sheet at the reheating temperature for 5 to 40 seconds, immediately cooling the steel sheet thus alloyed to a temperature not higher than 370° C., and then subjecting the steel sheet to an overaging treatment down to a temperature range from 250° to 320° C. for not shorter than 40 seconds, the said low carbon, Al-killed cold rolled steel sheet being obtained by soaking a steel slab containing by weight 0.01 to 0.02% carbon, not more than 0.3% silicon, 0.03 to 0.15% manganese, not more than 0.02% phosphorus, not more than 0.015% sulfur, 0.04 to 0.10% aluminum, and not more than 0.003% nitrogen, with the balance being iron and unavoidable impurities to a temperature satisfying the condition of $$950^\circ\ C. \leqq ST \leqq 7Mn/S + 1050^\circ\ C.$$

hot rolling the slab with a finishing temperature not lower than Ar3, coiling the hot rolled steel sheet at a temperature ranging from 600° to 700° C., and cold rolling the steel sheet.

* * * * *